US010072482B2

(12) United States Patent
Hodge et al.

(10) Patent No.: US 10,072,482 B2
(45) Date of Patent: Sep. 11, 2018

(54) LEAK-OFF ASSEMBLY FOR GRAVEL PACK SYSTEM

(71) Applicant: Weatherford Technology Holdings, LLC, Houston, TX (US)

(72) Inventors: Robert F. Hodge, Houston, TX (US); Stephen McNamee, Rhode (IE); John S. Sladic, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/212,528

(22) Filed: Jul. 18, 2016

(65) Prior Publication Data

US 2017/0022789 A1 Jan. 26, 2017

Related U.S. Application Data

(60) Provisional application No. 62/195,702, filed on Jul. 22, 2015.

(51) Int. Cl.

| | |
|---|---|
| ***E21B 43/04*** | (2006.01) |
| ***E21B 43/08*** | (2006.01) |
| ***E21B 43/267*** | (2006.01) |

(52) U.S. Cl.

CPC ..... *E21B 43/045* (2013.01); *E21B 43/04* (2013.01); *E21B 43/082* (2013.01); (Continued)

(58) Field of Classification Search

CPC ..... E21B 43/267

See application file for complete search history.

(56) References Cited

U.S. PATENT DOCUMENTS

| | | | |
|---|---|---|---|
| 4,945,991 | A | 8/1990 | Jones |
| 5,113,935 | A | 5/1992 | Jones et al. |
| 5,341,880 | A | 8/1994 | Thorstensen et al. |
| 5,515,915 | A | 5/1996 | Jones et al. |

(Continued)

FOREIGN PATENT DOCUMENTS

| | | | |
|---|---|---|---|
| WO | 02/097237 | A1 | 12/2002 |
| WO | 2004/099560 | A1 | 11/2004 |

(Continued)

OTHER PUBLICATIONS

Int'l Search Report and Written Opinion in counterpart PCT Appl. PCT/US2016/042743, dated Oct. 14, 2016, 11-pgs.

(Continued)

*Primary Examiner* — Wei Wang

(74) *Attorney, Agent, or Firm* — Blank Rome LLP

(57) ABSTRACT

Assemblies and methods pack a borehole annulus with gravel carried by a carrier fluid of a slurry. A manifold is disposed on tubing (e.g., basepipe). A number of first permeable structures in fluid communication with the manifold are disposed adjacent an impermeable (blank) section of the tubing. These first structures filter the slurry in the borehole annulus and pass the carrier fluid filtered into the manifold. A number of second permeable structures in fluid communication with the manifold are disposed adjacent a permeable (screen) section of the tubing. These second structures pass the carrier fluid from the manifold to the borehole annulus adjacent the screen section. In this way, the slurry in the blank section can be dehydrated for gravel packing by leaking of the carrier fluid to the screen section. The manifold and structures can also be beneficial in increasing the producible area of the tubing for production.

24 Claims, 12 Drawing Sheets

(52) U.S. Cl.
CPC ..... *E21B 43/084* (2013.01); *E21B 43/088* (2013.01); *E21B 43/267* (2013.01)

(56) References Cited

U.S. PATENT DOCUMENTS

| | | | |
|---|---|---|---|
| 5,868,200 | A | 2/1999 | Bryant et al. |
| 6,227,303 | B1 | 5/2001 | Jones |
| 6,405,800 | B1 | 6/2002 | Walker et al. |
| 6,409,219 | B1 | 6/2002 | Broome et al. |
| 6,520,254 | B2 | 2/2003 | Hurst et al. |
| 7,497,267 | B2 | 3/2009 | Setterberg, Jr. et al. |
| 7,918,276 | B2 | 4/2011 | Guignard et al. |
| 7,971,642 | B2 | 7/2011 | Yeh et al. |
| 8,281,855 | B2 | 10/2012 | Langlais et al. |
| 8,919,435 | B2 | 12/2014 | Greci et al. |
| 2002/0079099 | A1 | 6/2002 | Hurst et al. |
| 2002/0189809 | A1 | 12/2002 | Nguyen et al. |
| 2004/0140089 | A1 | 7/2004 | Gunneroed |
| 2010/0059232 | A1 | 3/2010 | Langlais et al. |
| 2010/0155064 | A1 | 6/2010 | Nutley et al. |
| 2010/0236779 | A1 | 9/2010 | Nutley et al. |
| 2013/0341006 | A1 | 12/2013 | Greci et al. |
| 2014/0076580 | A1 | 3/2014 | Holderman et al. |
| 2014/0110131 | A1 | 4/2014 | Cunningham et al. |
| 2015/0129194 | A1 | 5/2015 | Veit |
| 2015/0198016 | A1 | 7/2015 | Langlais |

FOREIGN PATENT DOCUMENTS

| | | | |
|---|---|---|---|
| WO | 2011/130122 | A2 | 10/2011 |
| WO | 2014/158141 | A1 | 10/2014 |

OTHER PUBLICATIONS

Weatherford, "Openhole Shunted Screen System," Brochure, copyright 2011.
Weatherford, "Shunt Tube Technology," Brochure, copyright 2011.

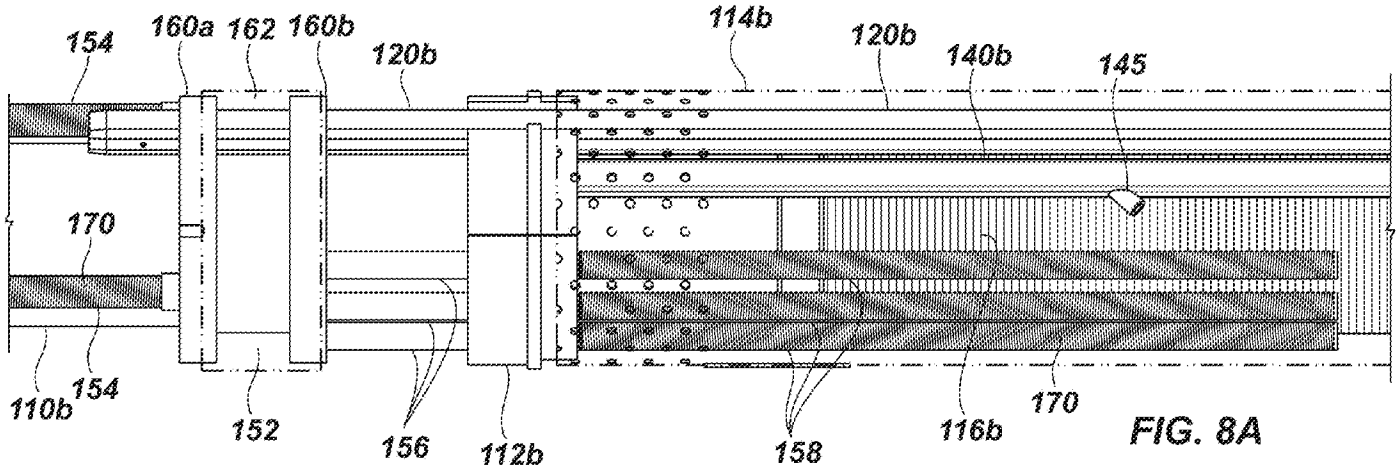
FIG. 8A
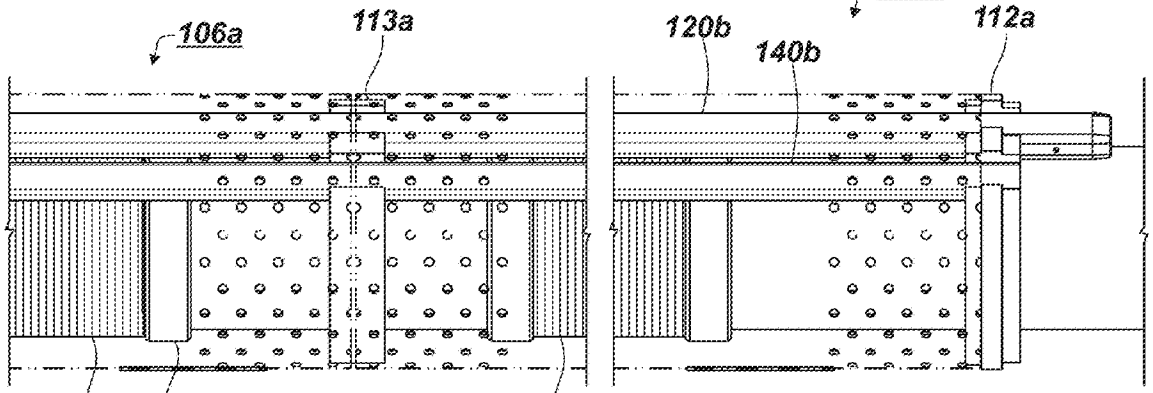
FIG. 8B
FIG. 8C

LEAK-OFF ASSEMBLY FOR GRAVEL PACK SYSTEM

CROSS-REFERENCE TO RELATED APPLICATIONS

This application claims the benefit of U.S. Prov. Appl. 62/195,702, filed 22 Jul. 2015, which is incorporated herein by reference.

BACKGROUND OF THE DISCLOSURE

Production of hydrocarbons from loose, unconsolidated, and/or fractured formations often produces large volumes of particulates along with the formation fluids. These particulates can cause a variety of problems. For this reason, operators use gravel packing as a common technique for controlling the production of such particulates.

To gravel pack or fracture pack a completion, a screen is lowered on a workstring into the wellbore and is placed adjacent the subterranean formation or in perforated casing. Proppant, sand, or particulate material (collectively referred to as "gravel") and a carrier fluid are pumped as a slurry down the workstring. Eventually, the slurry can exit through a "cross-over" into the wellbore annulus formed between the screen and the wellbore.

The carrier liquid in the slurry normally flows into the formation and/or through the screen itself. However, the screen is sized to prevent the gravel from flowing through the screen. This results in the gravel being deposited or "screened out" in the annulus between the screen and the wellbore to form a gravel-pack around the screen. The gravel, in turn, is sized so that it forms a permeable mass (i.e., a gravel pack) that allows produced fluids to flow through the mass and into the screen but blocks the flow of particulates into the screen.

Due to poor distribution, it is often difficult to completely pack the entire length of the wellbore annulus around the screen, which may lead to an interval in the annulus being incompletely packed with gravel. This poor distribution of gravel is often caused by the carrier liquid in the slurry being lost to the more permeable portions of the formation. Due to the loss of the carrier liquid, the gravel in the slurry forms "sand bridges" in the annulus before all of the gravel has been placed around the screen. Such bridges block further flow of the slurry through the annulus, thereby preventing the placement of sufficient gravel below the bridge in top-to-bottom packing operations or above the bridge in bottom-to-top packing operations.

Alternate flow conduits, called shunt tubes, can alleviate this bridging problem by providing a flow path for the slurry around such sections that tend to form sand bridges. The shunt tubes are typically run along the length of the wellscreen and are attached to the screen by welds. Once the screen assemblies are joined, fluid continuity between the shunt tubes on adjacent screen assemblies must be provided, and several techniques have been developed to provide such continuity.

FIGS. 1A-1B are schematic views of examples of sand screens 18*a-b* provided with shunt tubes 30*a-b* of a wellscreen assembly 10. FIG. 1C illustrates an exploded view of the components for the wellscreen assembly 10 for use in an open hole. As an alternative, FIG. 2 illustrates an exploded view of components for the wellscreen assembly 10 for use in a cased hole.

In the assembly 10, a first sand control device 12*a* is coupled to a second sand control device 12*b*, and each device 12*a-b* has basepipe joints 14 joined together to define a production bore 16. Screens 18*a-b* having filter media surround the basepipe joints 14 and are supported by ribs 19. The assembly 10 is provided with shunt tubes 30*a-b*, which in this example are steel tubes having substantially rectangular cross-section. The shunt tubes 30*a-b* are supported on the exterior of the screens 18*a-b* and provide an alternate flow path 32.

To provide fluid communication between the adjacent sand control devices 12*a-b*, jumper tubes 40 are disposed between the shunt tubes 30*a-b*. In this way, the shunt tubes 30*a-b* and the jumper tubes 40 maintain the flow path 32 outside the length of the assembly 10, even if the borehole's annular space B is bridged, for example, by a loss of integrity in a part of the formation F.

Additional examples of shunt tube arrangements can be found in U.S. Pat. Nos. 4,945,991 and 5,113,935. The shunt tubes may also be internal to the filter media, as described in U.S. Pat. Nos. 5,515,915 and 6,227,303.

As shown in FIGS. 1A-1C, the assembly 10 for an open hole completion typically has main shrouds 28*a-b* that extend completely over the sand control devices 12*a-b* and provides a protective sleeve for the filter media and shunt tubes 30*a-b*. The shrouds 28*a-b* have apertures to allow for fluid flow. The main shrouds 28*a-b* terminate at the end rings 20*a-b*, which supports ends of the shrouds 28*a-b* and have passages for the ends of the shunt tubes 30*a-b*. For a cased hole completion, the assembly 10 as shown in FIG. 2 may lack shrouds.

Either way, the shunt tubes 30*a-b* stop a certain length from the ends of the sand control devices 12*a-b* to allow handling room when the devices 12*a-b* are joined together at the rig. Once the devices 12*a-b* are joined, their respective shunt tubes 30*a-b* are linearly aligned, but there is still a gap between them. Continuity of the shunt tubes' flow path 32 is typically established by installing the short, pre-sized jumper tubes 40 in the gap.

Each jumper tube 40 has a connector 50 at each end that contains a set of seals and is designed to slide onto the end of the jumper tube 40 in a telescoping engagement. When the jumper tube 40 is installed into the gap between the shunt tubes 30*a-b*, the connectors 50 are driven partially off the end of the jumper tube 40 and onto the ends of the shunt tube 30*a-b* until the connectors 50 are in a sealing engagement with both shunt tubes 30*a-b* and the jumper tube 40. The shunt tubes' flow path 32 is established once both connectors 50 are in place. A series of set screws (not shown) can engage both the jumper tube 40 and adjoining shunt tube 30*a-b*. The screws are driven against the tube surfaces, providing a friction lock to secure the connector 50 in place.

This connection may not be very secure, and there is concern that debris or protruding surfaces of the wellbore can dislodge the connectors 50 from sealing engagement with the tubes 30*a-b* and 40 while running the wellscreen assembly 10 into the wellbore. Therefore, a device called a split cover 22 as shown in FIG. 1A is typically used to protect the connectors 50. The split cover 22 is a piece of thin-gauge perforated tube, essentially the same diameter as the main shrouds 28*a-b* of the screen assembly 10, and the same length as the gap between the end rings 20*a-b*. The perforated cover 22 is spit into halves with longitudinal cuts, and the halves are rejoined with hinges along one seam and with locking nut and bolt arrangements along the other seam. The split cover 22 can be opened, wrapped around the gap area between the sand control devices 12*a-b*, and then closed and secured with the locking bolts.

Typically, the split cover 22 is perforated with large openings that do not inhibit movement of the gravel and slurry. Primarily, the split cover 22 acts as a protective shroud so that the assembly 10 does not get hung up on the end rings 20*a-b* when running in hole or so the jumper tubes 40, connectors 50, and shunt tubes 30*a-b* are not damaged during run in.

As can be seen above, proppant or gravel in gravel pack or frac pack operations is placed along the length of a sand face completion whether it is open hole or cased hole. To place the gravel in a gravel pack operation, the carrier fluid carries the gravel to the sand face to pack the void space between the sand face and the sand screen. In a frac pack operation, the carrier fluid carriers the gravel to fracture the reservoir rock and to increase the sand face/gravel contact area. Then, the annular space is packed with the gravel between the cased or open hole and the sand screen.

To leave a fully supported gravel pack in the annulus, the carrier fluid dehydrates and leaves the gravel in a fully supported position. Depending on the operation, dehydration occurs through the reservoir sand face into the reservoir and/or through the sand screens 18*a-b* and up the wellbore 16. When fluid dehydrates through the sand screens 18*a-b*, there must be an adequate open area that provides access to flow paths allowing the carrier fluid to return up the well.

Most sand screen assemblies 10 have blank areas or gaps near the basepipe connections 15 where the sand screens 18*a-b* are made up when running in hole. These blank areas on the sand screen assemblies provide no open area for fluid dehydration. Consequently, gravel pack settling is unstable in these blank areas, creating unstable pack sections around the sand screens' blank area having voids or space. Gravel that has been packed uphole or downhole might eventually migrate or shift due to fluid flow and gravity. This shifting can expose sections of the screen and may lead to a loss of sand control.

These blank areas on sand screens with shunt tubes made for open hole gravel packs are further isolated by a large top ring of the lower joint and a larger bottom ring of the upper joint. The top and bottom rings support the transport and shunt tubes, but provide no open area for fluid dehydration. As a consequence, the top and bottom end rings can make the gravel pack settling in the blank area even more unstable. In fact, these unstable pack sections around the sand screen blank area provide voids or spaces that gravel from above might eventually migrate or shift due to fluid flow and gravity. This shifting creates exposed screen sections, which might lead to a loss of sand control.

For cased hole systems, it has often been assumed that gravity will cause the gravel to settle along the blank area and dehydrate below to the lower screen. For this reason, cased hole shunt tube systems may be less concerned with dehydrating the blank area. In open hole horizontal gravel pack with shunt tubes, however, a leak-off tube may be placed across each connection to provide a flow path up to the immediate screen above the connection. The fluid exits the leak-off tube and enters through the screen, passes then into the basepipe, and finally returns to the surface.

During gravel packing of the assemblies of FIGS. 1A-1C and 2, for example, gravel slurry can readily communicate around the blank area between the end rings 20*a-b* on the basepipes 14. For example, the slurry can readily enter through the shroud 22 and can collect in the blank area between the top and bottom end rings 20*a-b* around the basepipes 14. The slurry becomes trapped in the blank area because the gravel cannot dehydrate and the carrier fluid cannot return uphole. To deal with this, a leak-off tube 34 can be positioned in this blank area between the top and bottom end rings 20*a-b*. The leak-off tube 34 has openings (not shown) along it that allow the carrier fluid to enter from the slurry in the blank area so the gravel can dehydrate.

Although the leak-off tube may be effective to an extent to dehydrate slurry in the blank area, better distribution of gravel is desired in both open and cased holes to improve sand control. To that end, the subject matter of the present disclosure is directed to overcoming, or at least reducing the effects of, one or more of the problems set forth above.

SUMMARY OF THE DISCLOSURE

According to the present disclosure, an assembly is used with a screen joint for packing a borehole annulus with gravel carried by a carrier fluid of a slurry. The screen joint has a permeable section and an impermeable (blank) section. The assembly includes a manifold disposed on the screen joint. One or more first permeable structures are in fluid communication with the manifold and are disposed adjacent the blank section. The one or more first permeable structures filter the slurry in the borehole annulus and pass the carrier fluid filtered from the slurry into the manifold. One or more second permeable structures are in fluid communication with the manifold and are disposed along the permeable section. The one or more second permeable structures pass the carrier fluid from the manifold to adjacent the permeable section.

According to the present disclosure, an assembly is used for packing a borehole annulus with gravel carried by a carrier fluid of a slurry. The assembly includes a basepipe having a bore, a permeable section, and an impermeable (blank) section. A manifold is disposed on the basepipe. One or more first permeable structures are in fluid communication with the manifold and are disposed adjacent the first blank section. The one or more first permeable structures filter the slurry in the borehole annulus and pass the carrier fluid filtered from the slurry into the manifold. One or more second permeable structures are in fluid communication with the manifold and are disposed along the basepipe's permeable section. The one or more second permeable structures pass the carrier fluid from the manifold to adjacent the permeable section.

The basepipe can have a ring disposed on the basepipe that separates the blank section from the permeable section. The ring can be an end ring that support at least the one or more second permeable structures. For instance, the ring can define one or more passages communicating the carrier fluid for the one or more second permeable structures past the first ring.

In one alternative, the ring can form a portion of the manifold. For example, the ring can have at least two segments disposed around the basepipe, and at least one of the at least two segments can define a chamber for the manifold. In another alternative, the manifold can be disposed separate from the ring. In this case, one or more bypasses can communicate the manifold with the one or more second permeable structures at the ring.

In the assembly, a transport tube can have an end disposed at the ring to communicate the slurry along the basepipe. For example, the ring can define a passage passing the end of the transport tube through the ring. A jumper tube can also have an end coupled to the end of the transport tube to communicating the slurry with the transport tube. Moreover, a shunt tube can be disposed along the permeable section and can have an end at the ring. A passage in the ring can communicate the slurry from the transport tube to the shunt tube so that the slurry can be expelled to the borehole annulus around the permeable section.

Various arrangements for the permeable structures are disclosed. For example, the one or more first permeable structures can include a first number of first tubes, while the one or more second permeable structures can include a second number of second tubes being different from the first number. The tubes can have one or more screen sections, such as a wire-wrapped screen, disposed along a length of the tubes. In another example, the permeable structures can include a housing having a screen disposed over a chamber in the housing.

For the assembly, the permeable section can include a filter disposed on the basepipe to filter the slurry in the borehole annulus and pass the carrier fluid filtered from the slurry into a bore of the basepipe. The filter can be a wire-wrapped screen disposed on the basepipe adjacent perforations in the basepipe.

The assembly can have a number of basepipes coupled together. For two blank sections of connected basepipe, a shroud can be disposed to protect the permeable structures and the like. The permeable structures at the blank sections between connected basepipes can connect to one or more manifolds to communicate slurry to the permeable sections of the connected basepipes.

According to the present disclosure, a tubular of the assembly can be assembled by connecting basepipes together. A manifold positions on the tubular. To permit filtered communication of fluid from at least a blank section on the tubular to the manifold, the manifold communicates with one or more first permeable structures that extend adjacent at least the blank section. To permitting communication of the filtered fluid from the manifold to adjacent a permeable section on the tubular, the manifold communicates with one or more second permeable structures that extend adjacent the permeable section.

According to the present disclosure, packing a borehole annulus with gravel carried by a carrier fluid of a slurry involves conducting the slurry in an annulus of a borehole around tubing. The carrier fluid is filtered from the slurry in the borehole annulus into the tubing though permeable sections on the tubing. At impermeable sections of the tubing, the carrier fluid is filtered through one or more first permeable structures disposed at the blank sections. The filtered carrier fluid is conducted through the one or more first permeable structures to a manifold. Then, the filtered fluid from the manifold is leaked to adjacent at least a permeable section through one or more second permeable structures connected to the manifold.

The foregoing summary is not intended to summarize each potential embodiment or every aspect of the present disclosure.

BRIEF DESCRIPTION OF THE DRAWINGS

FIGS. 8A-8C illustrate respective details of the wellscreen and leak-off assemblies in FIG. 6.

DETAILED DESCRIPTION OF THE DISCLOSURE

Figure 1A:
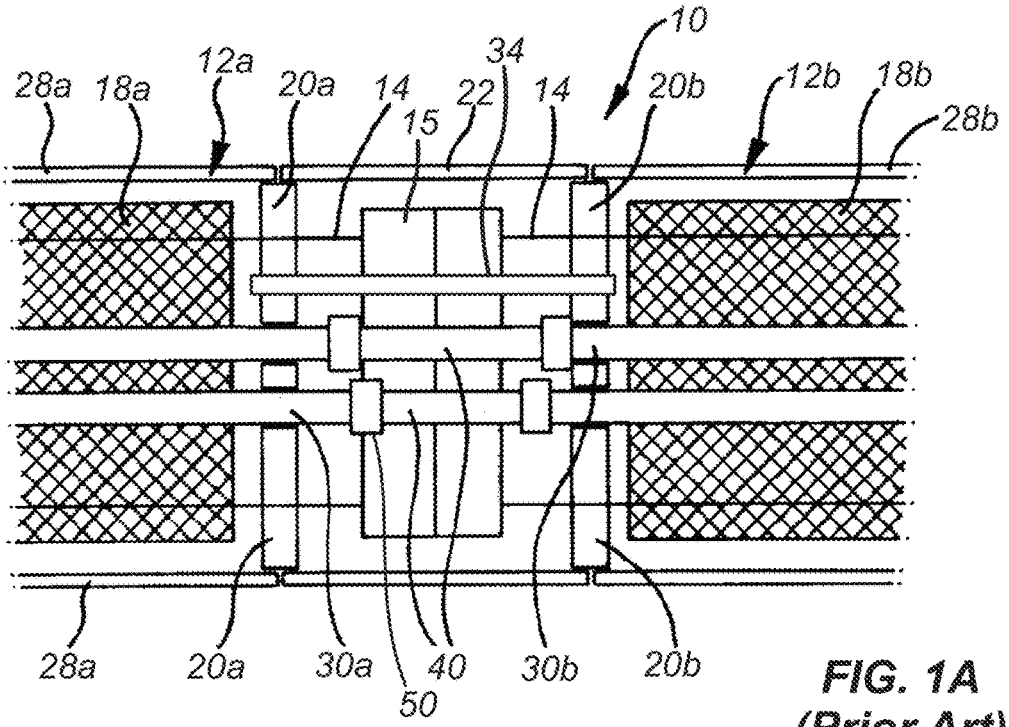
FIG. 1A (Prior Art)
FIG. 1A illustrates a side view of a wellscreen assembly according to the prior art for an open hole.
Figure 1B:
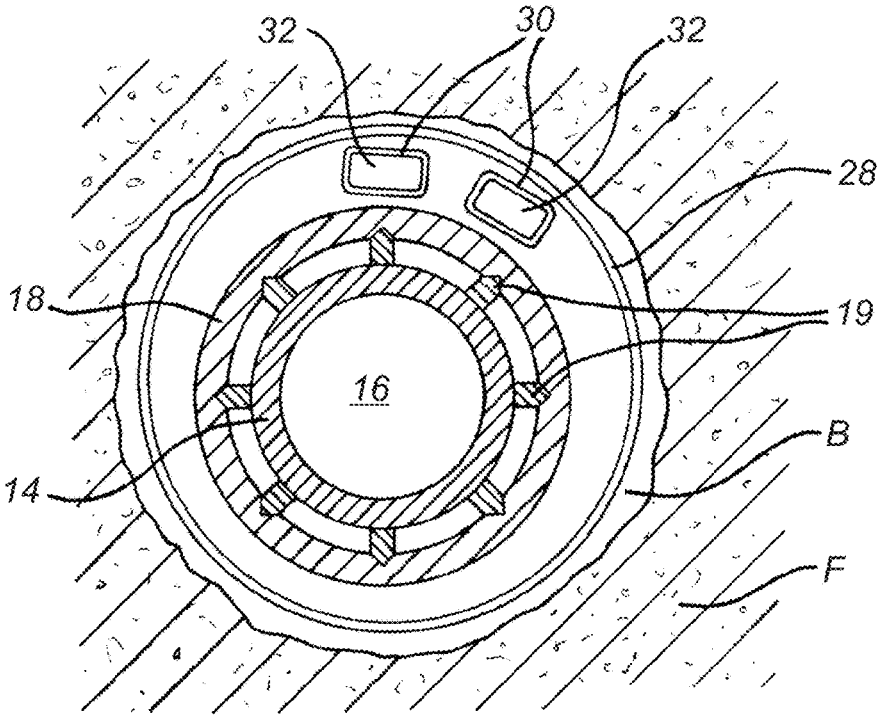
FIG. 1B (Prior Art)
FIG. 1B illustrates an end view of the open hole wellscreen assembly of FIG. 1A.
Figure 1C:
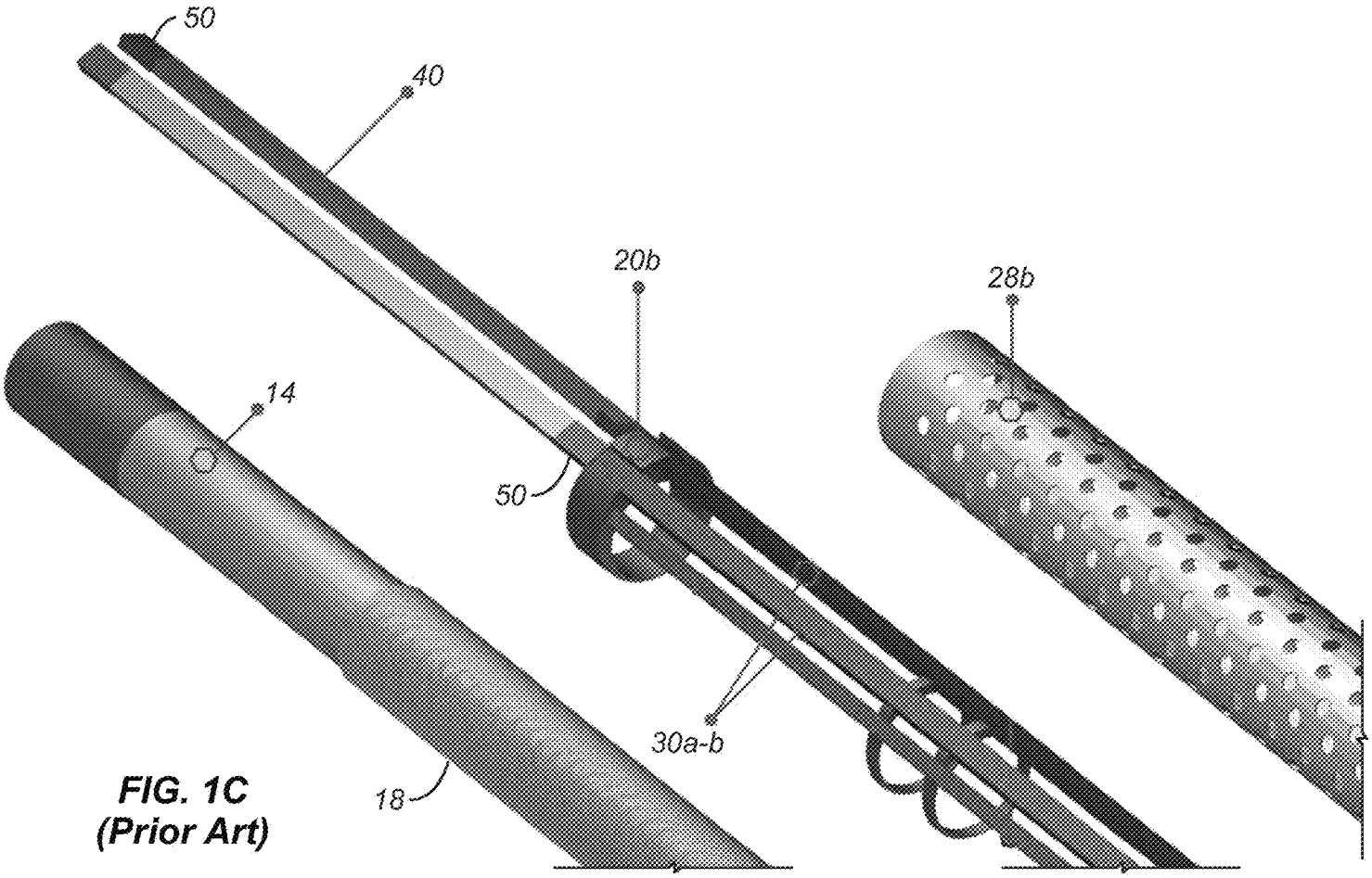
FIG. 1C (Prior Art)
FIG. 1C illustrates an exploded view of the components for the open hole wellscreen assembly of FIG. 1A.
Figure 2:
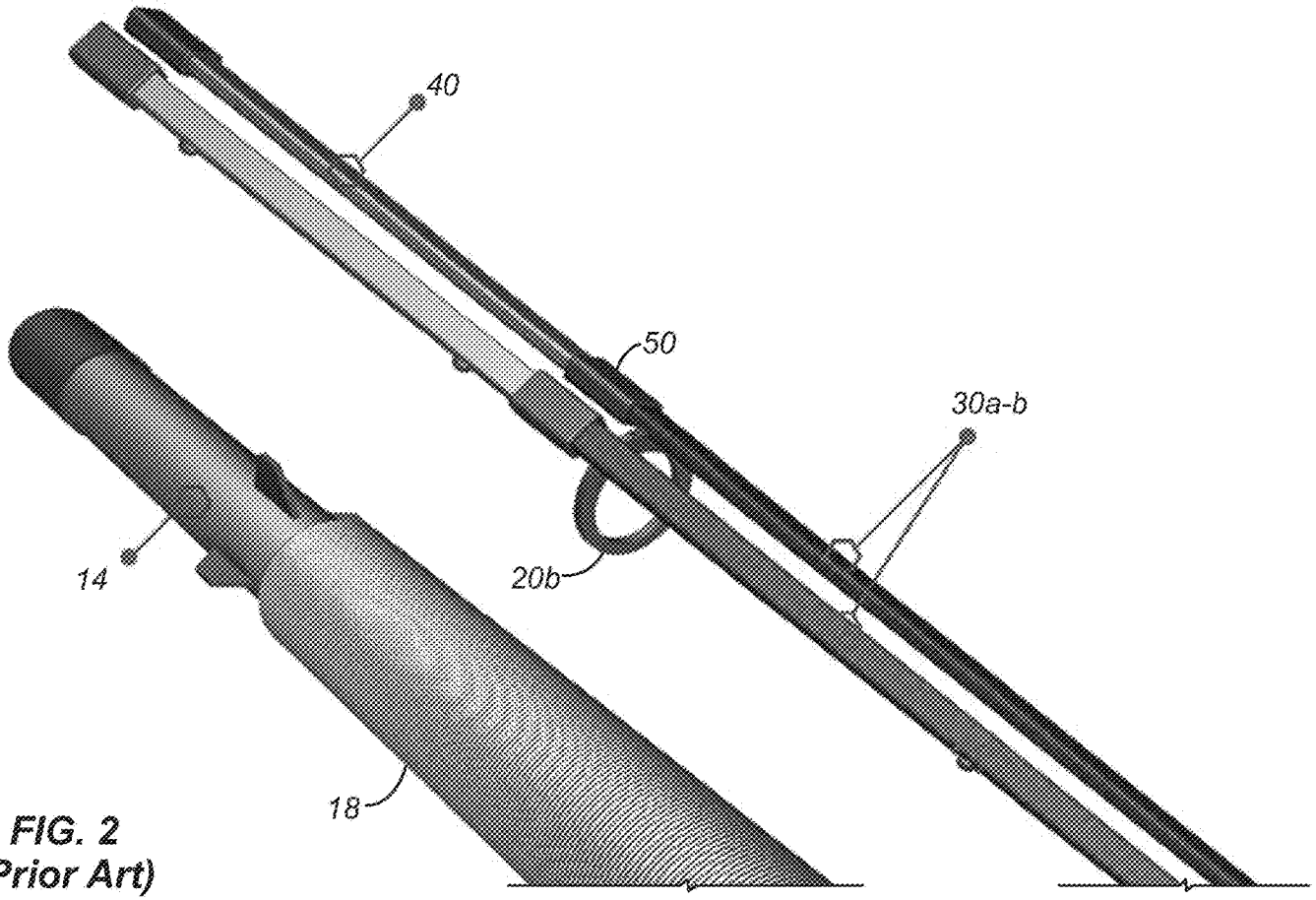
FIG. 2 (Prior Art)
FIG. 2 illustrates an exploded view of components for a cased hole wellscreen assembly.
Figure 3:
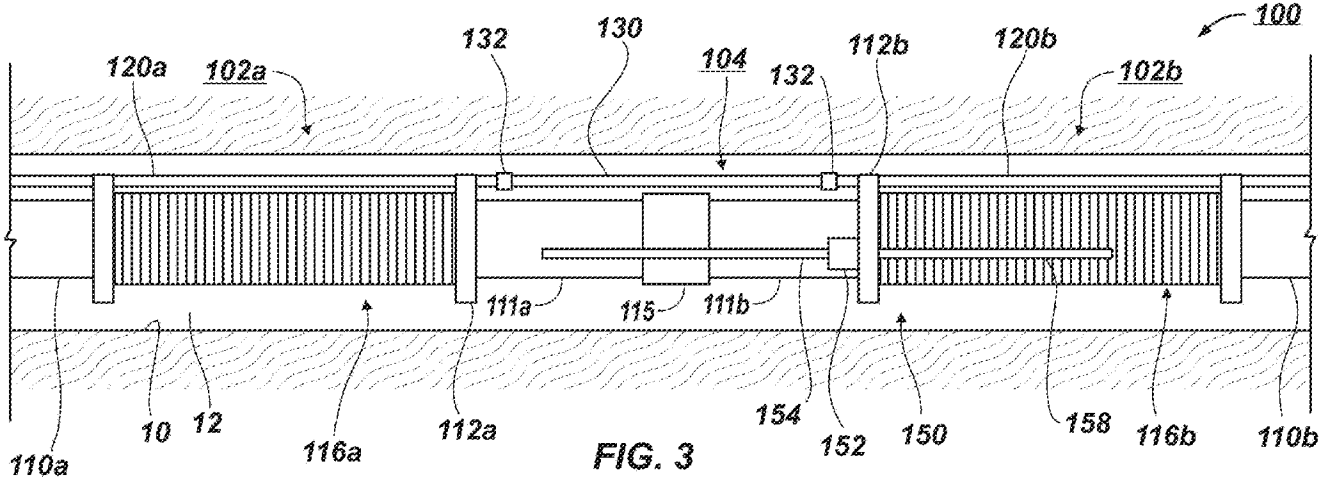
FIG. 3 illustrates a wellscreen assembly having a leak-off assembly according to the present disclosure.

FIG. 3 illustrates a wellscreen assembly 100 having a leak-off assembly 150 according to the present disclosure. The wellscreen assembly 100, such as a downhole sand screen assembly, is used in a borehole 10 to filter the flow of production fluid from the formation into production tubing. The wellscreen assembly 100 is made up of several screen joints 102*a-b* coupled together as part of the production tubing.

Shown in this limited view, the wellscreen assembly 100 has first and second joints or screen sections 102*a-b* longitudinally coupled together with a coupling 115, such as a threaded coupling. Each section 102*a-b* has a basepipe 110*a-b* that forms part of the overall tubing string disposed in the borehole 10. As shown here, the first screen section 102*a* has a first basepipe 110*a* with a first permeable section 116*a*, and the second screen section 102*b* has a second basepipe 110*b* with a second permeable section 116*b*.

For the permeable sections 116*a-b*, the basepipes 110*a-b* have perforations 119, slots, openings or the like under screens, filters, or the like so that fluid from the borehole annulus 12 can flow through the screens 116*a-b* and into the basepipes 110*a-b*. The screens or filters 116*a-b* can include any type of filter media for use downhole, including metal mesh, pre-packed screens, protective shell screens, expandable sand screens, or screens of other construction. As shown, the screen 116*a-b* can be a wire-wrapped screen having wire wrapped about longitudinal ribs running along a length of the basepipe 110*a-b*. During production, for example, the screens 116*a-b* filter fluid from the borehole 10 directly to perforations or openings 119 in the basepipes 110*a-b* communicating with the basepipe's bores, which make up the overall tubing's bore. The filtered production fluid can then pass up the basepipes 110*a-b* to the surface along the production tubing string.

To support the formation near the screens 116*a-b*, gravel, proppant, sand, or the like (not shown) can be packed in the borehole annulus 12. Additionally, proppant (e.g., sand) may have also been pumped prior to the gravel packing of the annulus 12. The proppant is used to prop open fractures (not shown) in the formation in a fracture-pack operation.

Figure 4A:
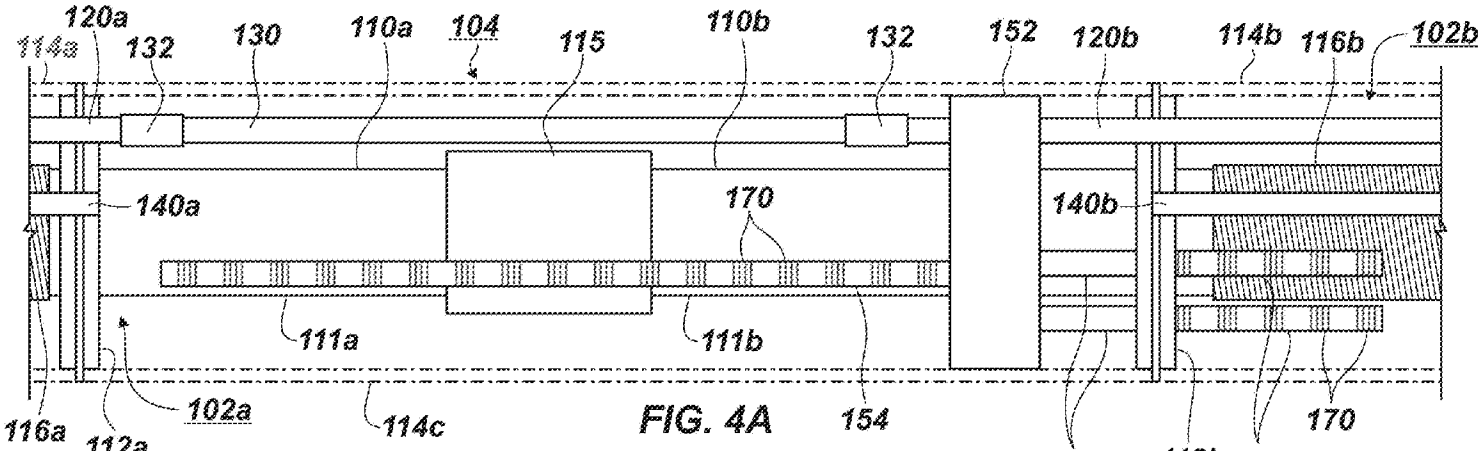
FIG. 4A illustrates the wellscreen assembly with the leak-off assembly in more detail.

For example, FIG. 3 illustrates the disclosed assembly 100 disposed in an open hole 10, and gravel (not shown) can be packed in the annulus 12 between the assembly 100 and the borehole 10. To place the gravel in a gravel or frac pack operation, the gravel is carried by a carrier fluid in a slurry that is pumped downhole and conveyed along sections of the wellscreen assembly 100. The slurry can travel directly in the borehole annulus. Also, various transport tubes 120, jumper tubes 130, and packing tubes (140*a-b*: FIG. 4A) can be used to transport the slurry. As the slurry collects in the borehole annulus 12 around the screens 116*a-b*, the carrier fluid leaks off through the screens 116*a-b* to leave the gravel about the screens 116*a-b*. Accordingly, the gravel collects or packs in the annulus 12, while the filtered carrier fluid can pass up the basepipes 110*a-b*.

As shown, shunt or transport tubes 120*a-b* run along the length of the screens 116*a-b* to deliver or transport slurry in an alternate path during the gravel pack or fracture pack operation. The transport tubes 120*a-b* are supported by top and bottom end rings 112*a-b* at the opposing ends of the screens 116*a-b* to hold the tubes 120*a-b* in place. The end rings 112*a-b*, therefore, tend to separate the screens 116*a-b* of the joints 102*a-b* from the blank area 104 between them.

Ends of the transport tubes 120*a-b* extend from the end rings 112*a-b*, and jumper tubes 130 interconnect to the ends of these transport tubes 120*a-b* on the adjoining screen sections 102*a-b* across the blank area 104 (i.e., the area between the basepipes 102*a-b* at the coupling 115 where the sections 102*a-b* are impermeable and do not have screens). Connectors 132 having seals can connect the ends of the jumper tube 130 with the ends of the transport tubes 120*a-b*. In general, the assembly 100 can have any number of transport tubes 120*a-b*. The pack tubes 140*a-b* can be used to deliver slurry out of nozzles (145: FIG. 8A) on the tubes 140*a-b*, while the transport tubes 120*a-b* may transport the slurry further along the assembly 100 to other locations.

For handling and assembly to connect the basepipes 110*a-b* at the surface for deployment downhole, the basepipes 110*a-b* have blank ends 111*a-b* in the blank area 104 where they couple together. Various pieces of surface handling equipment need to engage these blank ends 111*a-b* to connect the basepipes 110*a-b* together. In this way, the blank area 104 between the top and bottom end rings 112*a-b* can provide an area for tongs or other implements to engage the basepipes 110*a-b* for handling during operations. For example, during operations to make up the tubing string and run the assembly 100 downhole, operators connect the upper basepipe 110*a* to the lower basepipe 110*b*, which both typically have the screens 116*a-b*, top and bottom rings 112*a-b*, transport tubes 120*a-b*, shrouds, etc. already assembled thereon. Operators make up the coupling 115 by connecting the ends 111*a-b* of the basepipes 110*a-b* together with the coupling 115 using the blank ends 111*a-b* of the basepipes 110*a-b* for handling.

Once connected, various pieces of the wellscreen assembly 100 need to be assembled in the blank area 104 to interconnect one screen joint 102*a* with the other joint 102*b*. In particular, the jumper tube 130 installs with the connectors 132 across the blank area 104 to connect adjoining transport tubes 120*a-b* for gravel pack slurry. One or more shrouds (not shown) may also be assembled around the screens 116*a-b* and the blank area 104.

Before such shrouds are installed, however, components of the leak-off assembly 150 according to the present disclosure are installed to provide a path for the leak-off of carrier fluid in the blank area 104 to the area of the screens 116*a-b*. As already noted, the ability to leak the carrier fluid in the blank area 104 can aid in producing a more uniform gravel pack around the screen sections 102*a-b* in the borehole annulus 12. Once the leak-off assembly 150 is assembled, then any shrouds or the like can be installed. The tubing may then be rung downhole, and the next and subsequent couplings 115 between joints 102 for the tubing string can then be made up and run in the same way.

As briefly shown in FIG. 3, the leak-off assembly 150 increases the effective open area to dehydrate the blank area 104 between the screen joints 102*a-b*. Thus, the leak-off assembly 150 provides increased open area in the blank area 104 and increased open area over the screen sections 102*a-b* to improve dehydration efficiency of slurry over the blank area 104. Moreover, the leak-off assembly 150 can be configured to provide more than just leak-off. In fact, because the leak-off assembly 150 is configurable as disclosed herein for various implementations, the leak-off assembly 150 can provide additional production capabilities in the blank area 104 between the screen joints 102*a-b*.

To do this, the leak off assembly 150 conveys fluid from the impermeable section (i.e., blank area 104) of the wellbore assembly to a permeable section (i.e., screen 116*b*) of the wellbore assembly using separate permeable structures 154, 158 and a manifold 152. The permeable structures 152, 158 provide a leak-off path for the assembly 100 when used in gravel pack and frac pack operations and can further provide a production path during production operations.

As shown here, the permeable structures 154, 158 are tubes that are permeable at least along a portion thereof by use of slots, perforations, filters, screens, mesh, etc. The one or more first tubes 154 in fluid communication with the manifold 152 are disposed in the blank area 104 adjacent the blank end, while one or more second tubes 158 in fluid communication with the manifold 152 are disposed along the screen 116*b*. The first leak-off tube(s) 154 positioned over the blank area 104 are dehydrating tubes that retain the gravel and allows carrier fluid of the slurry to exit the impermeable section of this blank area 104 into the leak-off manifold 152. The one or more first tubes 154 therefore filter the slurry in the borehole annulus 12 in the blank area 104 between the joints 102*a-b* and pass the carrier fluid filtered from the slurry into the manifold 152.

Figure 5:
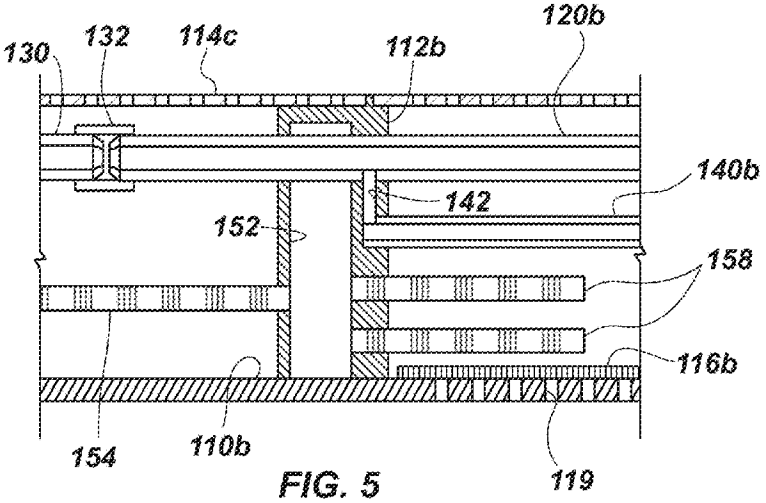
FIG. 5 illustrates a schematic cross-sectional view of another configuration for the disclosed leak-off assembly.
Figure 4B:
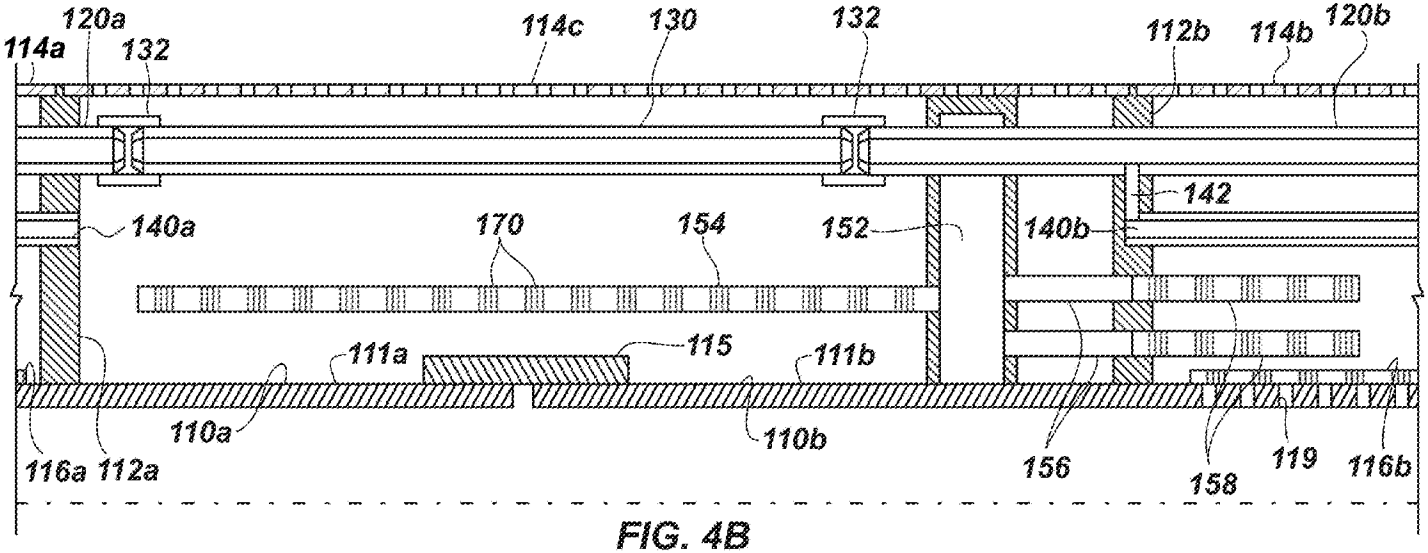
FIG. 4B illustrates a schematic cross-sectional view of the wellscreen assembly having the disclosed leak-off assembly.

Fluid in the blank area 104 can enter the one or more first tubes 154, which filter the carrier fluid from the slurry and dehydrate gravel from the slurry in the blank area 104. The filtered fluid can then pass from inside the tubes 154 to the manifold 152. From there, the one or more second tubes 158 pass the carrier fluid from the manifold 152 to adjacent the screen 116*b*. In this sense, the second leak-off tubes 158 are conveying tubes that allow the carrier fluid without gravel to migrate from the leak-off manifold 152 to the permeable screen 116*b*. The filtered fluid can pass from the one or more second tubes 158, to the area near the screen 116*b*. Eventually, the fluid passes through the basepipes' screen 116*b* and perforations (e.g., 119: FIGS. 4B & 5) into the basepipe's bore.

Depending on available space, the manifold 152 can be disposed on either side of the top end ring 112*b*. In this particular example, however, the manifold 152 is disposed on the outer side of the top end ring 112*b* at the blank area 104 of the basepipe 110*b* because this area typical offers more space, and the manifold 152 does not cover part of a screen.

As shown, the leak-off assembly 150 provides more open areas for the gravel to dehydrate so gravel packing can be more uniform in the blank area 104. The leak-off assembly 150 helps the annulus fill with gravel with reduced variations that could cause premature bridging in the borehole 10. In this way, leak-off assembly 150 provides a secondary sand control function for the standard screens 116*a-b*. Finally, once gravel packing is completed, the leak-off assembly 150 can provide more production surface are for produced fluid to enter the tubing string during production.

As can be seen, the manifold 152 can be advantageously positioned when designing and assembling the assembly 100. The manifold 152 is a distributor allowing more or less dehydration (via tubes 154) to be configured relative to more or less leak-off (via tubes 158). Overall, the leak-off assembly 150 is modular and may or may not be added to various screen joints on a gravel pack assembly when deployed downhole.

Given the brief explanation of the wellscreen and leak-off assemblies 100 and 150 of FIG. 3, discussion now turns to some additional details of the assemblies as shown in FIGS. 4A-4B. In particular, FIG. 4A illustrates a side view of the wellscreen assembly 100 with the leak-off assembly 150, and FIG. 4B illustrates a schematic cross-sectional view of the wellscreen assembly 100 having the disclosed leak-off assembly 150.

As discussed previously, the basepipes 110*a-b* of the joints 102*a-b* couple end-to-end with the coupling 115 at the blank area 104 between them. For simplicity, primarily only the blank area 104 between the joints 102*a-b* is shown in FIGS. 4A-4B. Thus, the (bottom) end ring 112*a* of the upper joint 102*a* is shown at one end of the blank area 104, while the (top) end ring 112*b* of the lower joint 102*b* is shown at the other end of the blank area 104.

The end rings 112*a-b* can be affixed to the basepipes 110*a-b* with welding or the like, as part of the assembly process of the joints 102*a-b*. The end rings 112*a-b* can overlap portion of the screens 116*a-b*, or separate securing rings can be used to support the screens 116*a-b* on the basepipes 110*a-b*.

To convey slurry, a transport tube 120*a* running along the upper joint 102*a* extends beyond the bottom end ring 112*a*. A jumper tube 130 connects by a connector 132 to the exposed end of the transport tube 120*a* and extends to an adjoining end of the second joint's transport tube 120*b*, with which it also couples with a connector 132. This second transport tube 120*b* extends adjacent its screen 116*b* to convey slurry further down the wellscreen assembly 100. Although not shown in particular here, the end rings 112*a-b* can have openings for passage of the ends of the transport tubes 120*a-b*, and the openings for tubes 120*a-b* may have seals (not shown), brazed material, tight clearance fits, or the like to prevent fluid communication. Pack tubes 140*a-b* may also terminate at the end ring 112*a-b* and can communicate via pathways 142 with the transport tubes 120*a-b*.

As already noted, one or more shrouds 114*a-c* can be disposed around various sections of the wellscreen assembly 100. In fact, the first joint 102*a* may include a shroud section 114*a* protecting its screen 116*a*, transport tubes 120*a*, etc., and the second joint 102*b* may include its own shroud section 114*b* protecting its components. Finally, an intermediate shroud section 114*c* can be disposed across the adjoining end rings 120*a-b* of the two joints 102*a-b* to protect components of the leak-off assembly 150 in the blank area 104 between them.

The leak-off assembly 150 includes the one or more first tubes 154 connected to the manifold 152 and extending along the blank area 104 between the joints 102*a-b*. The one or more second tubes 158 connected to the manifold 152 then extend adjacent the screen 116*b* of the lower joint 102*b*.

As shown in this example, the manifold 152 can be mounted separate from the top end ring 112*b*. Accordingly, sections or through tubes 156 for the one or more second tubes 158 may extend past the top end ring 112*b* and to the manifold 152. As particularly shown here, one or more through-tubes 156 communicate the manifold 152 with the one or more second tubes 158 at the end ring 112*b*.

The dehydrating and conveying tubes 154, 158 have one closed end and one open end. The open ends communicate with the leak-off manifold 152. With the configuration of the assembly 150, the leak-off manifold 152 permits one or more of the dehydrating tubes 154 to be used. Depending on the installation, multiple dehydration tubes 154 can improve the rate of dehydration or removal of fluids from the gravel pack slurry in the impermeable handling area 104 between the screen joints 102*a-b*. The multiple conveying tubes 158 complete the dehydration of the impermeable blank area 104 by delivering the leaked off fluid to the screen 116*b*. By using the manifold 152, the number of dehydrating tubes 154, the type of dehydrating tube 154, and/or the size of dehydrating tube 154 maybe different than the number, type, and/or size of the conveying tubes 156 to provide different permeability. The manifold 152 also allows for temporary collection and holding of carrier fluid therein, which may be beneficial in some operations.

The one or more dehydrating tubes 154 are permeable, porous, or filtered along at least a portion thereof to pass carrier fluid leaked off from the blank area 104 into the tubes 154 while preventing passage of gravel or other particulates. Similarly, the one or more conveying tubes 158 are also permeable, porous, or filtered along at least a portion thereof to deliver the carrier fluid leaked off from the blank area 104 to the borehole annulus adjacent the screen 116*b*.

To prevent possible clogging by cross-flow, the second tubes 158 can also prevent passage of gravel or other particulates into the tubes 158. Accordingly, the tubes 158 can be perforated, covered with screens or other filter media, or can have some other filtering configuration. The through-tubes 156 may or may not be perforated. In fact, the through tubes 156 as noted herein may simply be extensions of the second tubes 158.

The dehydrating and conveying tubes 154, 158 may be any type of permeable tube that provides for retention of gravel, proppant, or sand while allowing carrier fluid or wellbore fluid to pass through the inner diameter of the tubes 154, 158. The tubes 154, 158 may be made of wire-wrapped screen, woven metal mesh, slotted tube, drilled tube, etc. In general, the tubes 154, 158 can be made permeable with any number of methods, such as being perforated, covered with screens or other filter media, or having some other filtering configuration. The tubes 154, 158 are normally round but can have any other shape. As one particular example, the tubes 154, 158 can have an extent of wire-wrapped screen formed or disposed thereon.

As schematically shown here, the manifold 152 may be an enclosed space with which the tubes 154 and 158 communicate. To form the enclosed space, the manifold 152 can use a number of components as will be appreciated. Overall, the leak-off manifold 152 provides a chamber or space for fluid to pass from the dehydrating tubes 154 to the conveying tubes 158. The manifold 152 may itself be impermeable or permeable. It can be a round cylinder, but can have any other shape.

In the previous embodiment of FIGS. 4A-4B, the manifold 152 was depicted as a separate component disposed on the blank end 111*b* of the basepipe 110*b* apart from the top end ring 112*b*. This is not strictly necessary as other configurations can be used. In particular, the features of the manifold 152 can form part of or be incorporated into the features of the top end ring 112*b* (or bottom ring 112*a* as the case may be). For example, FIG. 5 illustrates a schematic cross-sectional view of another configuration for the disclosed leak-off assembly 150 in which the manifold 152 is part of or incorporated into the top end ring 112*b*. This arrangement can simplify the assembly 150 in that sections of short connector tubes (e.g., 156 as seen in FIGS. 4A-4B) may not be needed.

Figure 6:
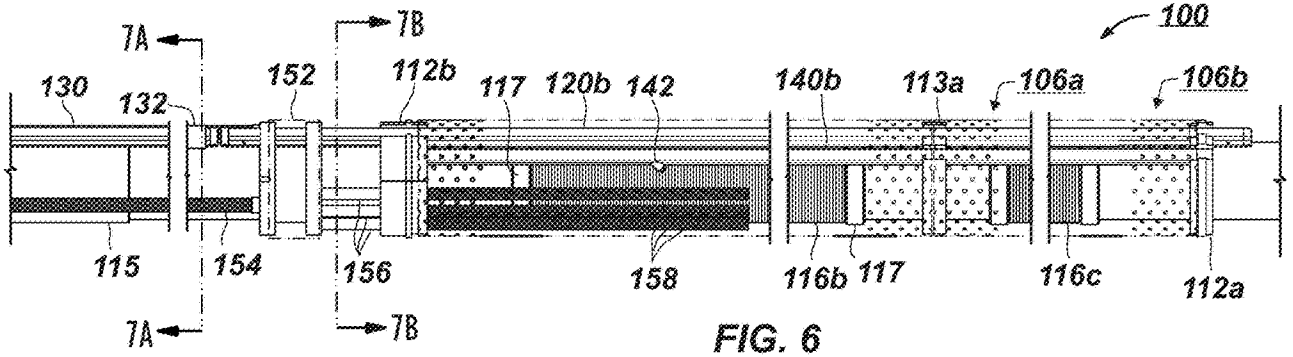
FIG. 6 illustrates a side view of one embodiment of a wellscreen assembly and disclosed leak-off assembly.
Figure 7B:
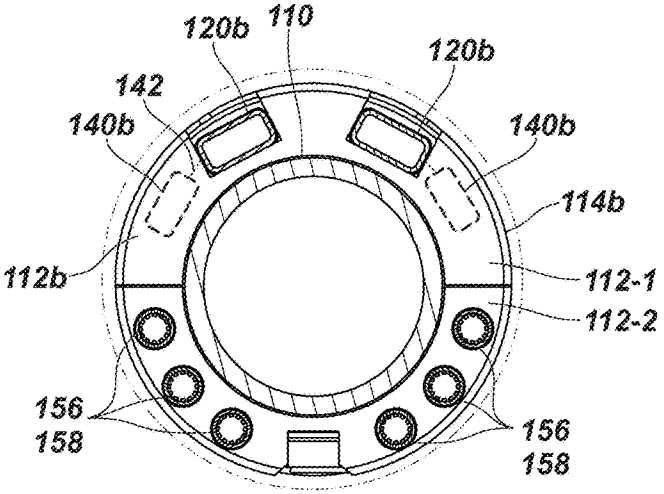
FIGS. 7A-7B illustrate sectional end views of the wellscreen and leak-off assemblies in FIG. 6.
Figure 7A:
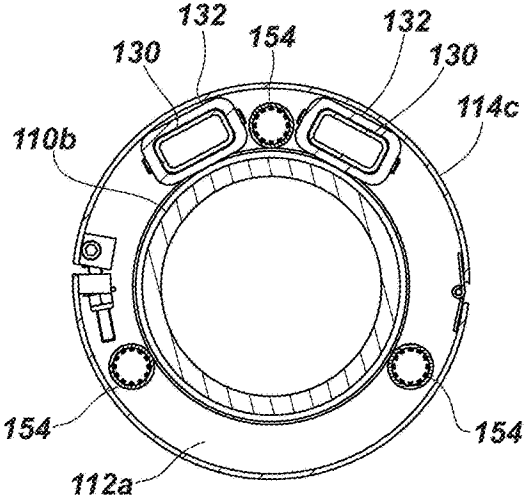

Given the above-discussion of the wellscreen and leak-off assemblies 100 and 150 of the present disclosure, FIG. 6 now illustrates a side view of one particular embodiment of a wellscreen assembly 100 and a leak-off assembly 150 of the present disclosure. (End views of the assembly 100 are shown in FIGS. 7A-7B, and respective details of the components in FIG. 6 are separately illustrated in FIGS. 8A-8C.) Like reference numerals to previous embodiments are used here for similar components, which may not be discussed again for the sake of brevity.

As is typical and as is depicted here, the basepipe 110*b* of the lower joint 102*b* may have multiple permeable sections with screens 116*b-c* disposed therein. Screen rings 117 can secure these screens 116*b-c* in place on the basepipe 110*b*. Additionally, intermediate rings 113*a* may be disposed between such screens 116*a-b* to support the components of the assembly 100, such as the transport tubes 120*b*, shrouds 114*b*, etc.

As is also typical and as is depicted here in FIGS. 3 through 6, the end rings 112*a-b* can have slots or openings to accommodate passage of the transport tubes 120*a-b* and shunt tubes 140*a-b*. As shown in the sectional end view of FIG. 7B, for example, the top end ring 112*b* defines passages for the transport tubes 120*b* through the top end ring 112*b*. Fluid ports 142 in the top end ring 112*b* (or separate conduits or junctures) may connect the transport tubes 120*b* to the shunt tubes 140*b*.

The leak-off assembly 150 in this embodiment includes a number (e.g., three) dehydration tubes 154 disposed along the blank area 104. As depicted in FIG. 7A, these tubes 154 can be disposed uniformly around the assembly's circumference to improve coverage.

The leak-off assembly 150 in this embodiment also includes a number (e.g., six) conveyance tubes 158 disposed along the lower joint's screen 116*b*. As shown in FIG. 7B, these tubes 158 can be disposed towards one side of the wellscreen assembly 100, such as the side opposite the transport tubes 120*b* and shunt tubes 140, although other placements and arrangements can be used.

As best shown in FIG. 8A, the manifold 152 can be formed from rings 160*a-b* disposed with a separation on the blank end 111*b* of the basepipe 110*b*. An exterior covering or sleeve 162 can be disposed around that separation to enclose the space between the rings 160*a-b* of the manifold 152. The covering 162 can be impermeable or can be permeable, such as a screen. The through-tubes 156 can extend from openings in one of these rings 160*b* to the top end ring 112*b* where the conveying tubes 158 can then extend over the screen 116*b*.

As can be seen throughout the figures, the leak-off tubes 154 and 158 comprise screens 170 either along their entire length or a portion thereof. The screens 170 are wire-wrapped type screens having longitudinal rods with wire wound about them. Although the entire extent of the tubes 154, 158 may include a screen, this is not strictly necessary.

To control leak-off and production, the screening provided by the screens 170 on the tubes 154, 158, can be the same as or different from the screening provided by the joint's screens 116*a-c*, which are to be used for production. In this regard, the screen 170 of the tubes 154, 158 may be wire-wrapped screen or the like and may have gaps or slots to prevent passage of gravel. However, the size of the wire, the number of gaps, the number of slots, etc. may be less than used on the production screens 116*a-c*. Alternatively, the amount of surface area for screening provided by the tubes 154, 158 may be configured different relative to that provided by the production screens 116*a-c*. In this way, using any of these various differences, the tubes 154, 158 can provide leak-off capabilities during gravel pack operations, but wellbore fluids would tend to flow more preferentially through the pipe's screens 116*a-c* during production operations due to the greater amount of open surface area of the screens 116*a-c*. Other configurations can be used and can be configured for a particular implementation. For example, the tubes' screens 170 may be configured to enhance production.

Figure 9A:
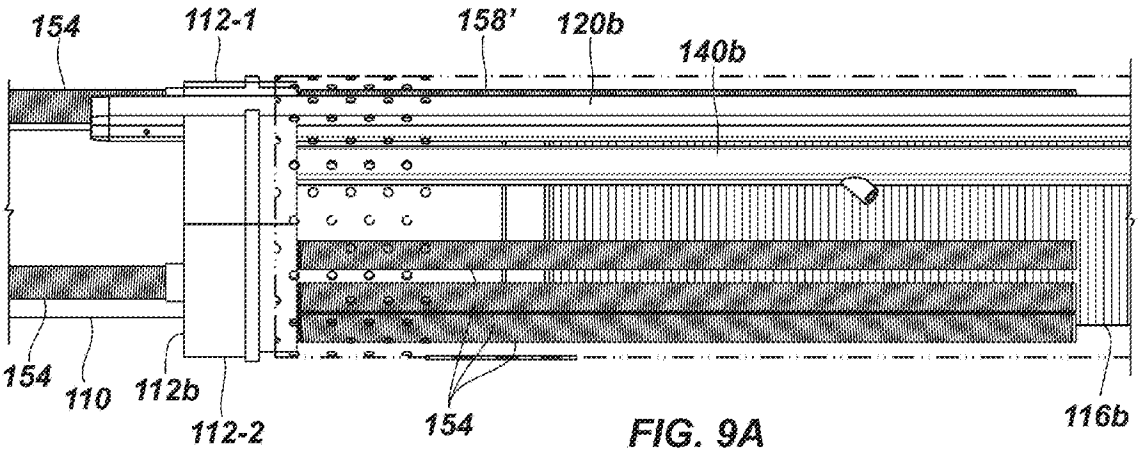
FIG. 9A illustrates a side view of a wellscreen assembly having an alternative leak-off assembly of the present disclosure.
Figure 9C:
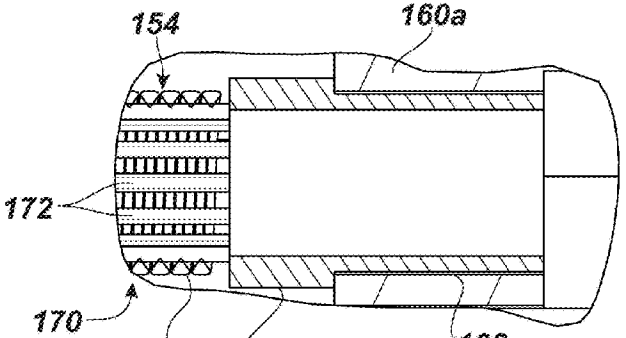
FIG. 9C illustrates a detail of a coupling between a leak-off tube and the manifold of the disclosed leak-off assembly.
Figure 9B:
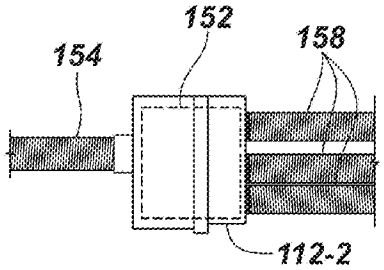
FIG. 9B illustrates a detail of the alternative leak-off assembly of FIG. 9A.

FIG. 9A illustrates a side view of a wellscreen assembly 100 having an alternative leak-off assembly 150 of the present disclosure. In previous embodiments, the dehydration tubes 154 in the blank area 104 connected to the manifold 152 of the leak-off assembly 150, and separate through-tubes 156 connected from the manifold 152 to the top end ring 112*b* for communication with the conveyance tubes 158 adjacent the screen 116*b*. As also noted previously, the manifold 152 can be part of or incorporated into the top end ring 112*b*. FIG. 9A shows one particular way to do that. Here, as before, the end ring 112*b* is segmented having first and second segments 112-1 and 112-2 that connect together around the end of the basepipe 110*b*. The upper segment 112-1 accommodates the transport and packing tubes 120*b*, 140*b*. The lower segment 112-2 accommodates a chamber formed therein for the manifold 152. FIG. 9B illustrates a detail of the alternative leak-off assembly 150 of FIG. 9A with the lower segment 112-2 having the chamber for the manifold 152.

In this way, the first tubes 154 can connect directly to the sidewall of the lower segment 112-2 and communicate with the chamber of the manifold 152. Similarly, the second tube 158 can also connect directly to the sidewall of the lower segment 112-2 and extend over the screen 116*b*.

The open ends of these wire-wrapped tubes 154 and 158 can affix in a number of ways to the manifold 152 and top end ring 112*b*. In one particular example of FIG. 9C, a junction 164 affixes in an opening 166 in the end ring (e.g., 160*a*, 112*b*, or the like), such as the end ring 160*a* of the manifold 152 in this case. The junction 164 can thread into the opening 166 or affix in other ways. Moreover, the junction 164 can seal with various types of seals, such as an O-ring seal (not shown), in the opening 166. The rods 172 of the tube's screen 170 affix to the junction 164 by welding or the like, and the wire 174 winds and welds around the rods 172. In this way, the tube 154 can be manufactured with the screen 170 and junction 164. For assembly, the junction 164 can then affix in the opening in the end ring 160*a*.

As shown, the wire 174 can be V-wire as used in typical wire-wrapped screens and can be welded to the rods in a comparable assembly. The gaps between the winds of the wire 174 can be configured to allow passage of fluid and prevent passage of particulate of a given size.

Figure 10:
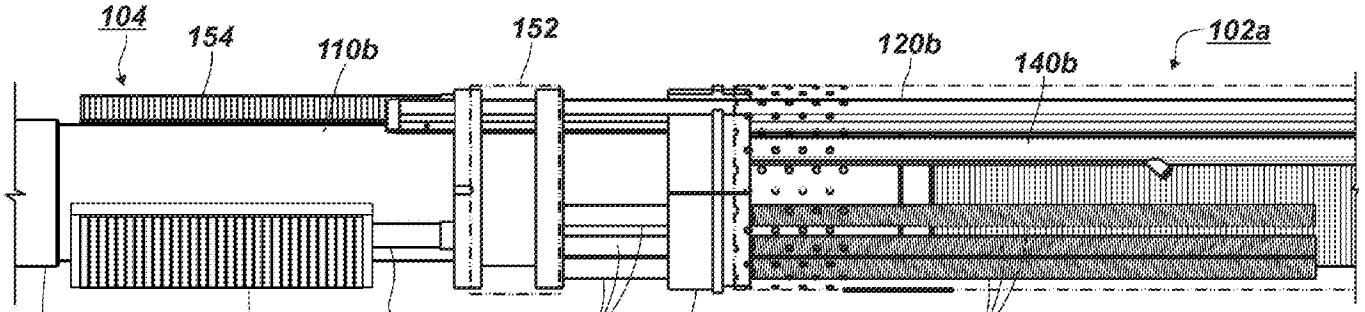
FIG. 10 illustrates a side view of a wellscreen assembly having another alternative leak-off assembly of the present disclosure.
Figure 11B:
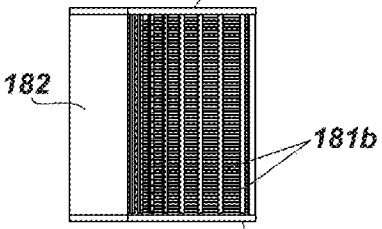
FIGS. 11A-11E illustrates perspective, top, end, and two side views of a permeable structure for the disclosed leak-off assembly.
Figure 11A:
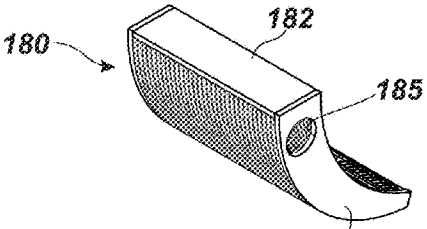
Figure 11E:
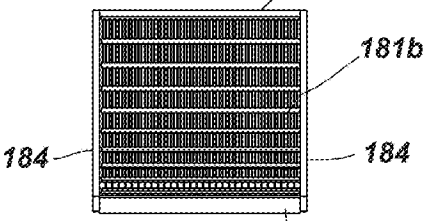
Figure 11C:
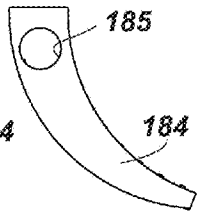
Figure 11D:
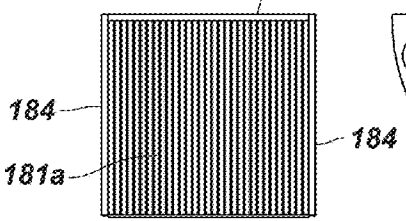

FIG. 10 illustrates a side view of a wellscreen assembly 100 having another alternative leak-off assembly 150 of the present disclosure. In previous embodiments, the permeable structures connected to the manifold 152 of the leak-off assembly 150 were dehydration tubes (i.e., 154). As will be appreciated with the benefit of the present disclosure, other structures can be used. As shown here for example, the permeable structures in the blank area 104 can include screen members 180. These screen members 180 can fit adjacent the blank end 111*b* of the basepipe 110*b* (as well as the blank end 111*a* of the other basepipe 110*a*). The screen members 180 can connect to the manifold 152 using tubes 188 or the like. The screen members 180 have screens 181*a* for filtering the carrier fluid from the slurry in the blank area 104 to dehydrate gravel.

FIGS. 11A-11E illustrates perspective, top, end, and two side views of a screen member 180 for the leak-off assembly 150 of FIG. 10. The screen member 180 includes a screen 181*a* on an outer surface with a number of sidewalls 182, 184, 186 enclosing an open side 181*b* that fits against the basepipe 110*b*. Sealing, welding, affixing, or the like can be used to seal/connect the sidewalls 182, 184, 186 to the basepipe 110*b*. One of the sidewalls 184 can have a port 185 for connecting to the tube (188) and communicating fluid filtered through the screen 181*a* in the chamber of the member 180 to the manifold (152) via the tube (188).

As shown, the screen member 180 can encompass a segment, such as a quarter, of a cylinder to provide circumferential coverage of a portion of the blank area 104. Other shapes can be used. Additionally, instead of an open side 181*b*, the member 180 can have another screen on this inner side. The number and placement of the screen members 180 can be configured in the blank area 104 as needed for a particular implementation. Moreover, several of the screen members 180 can be chained together using the tubes 188, and the screen members 180 need not only be used at the one blank end 111*b*.

Figure 12:
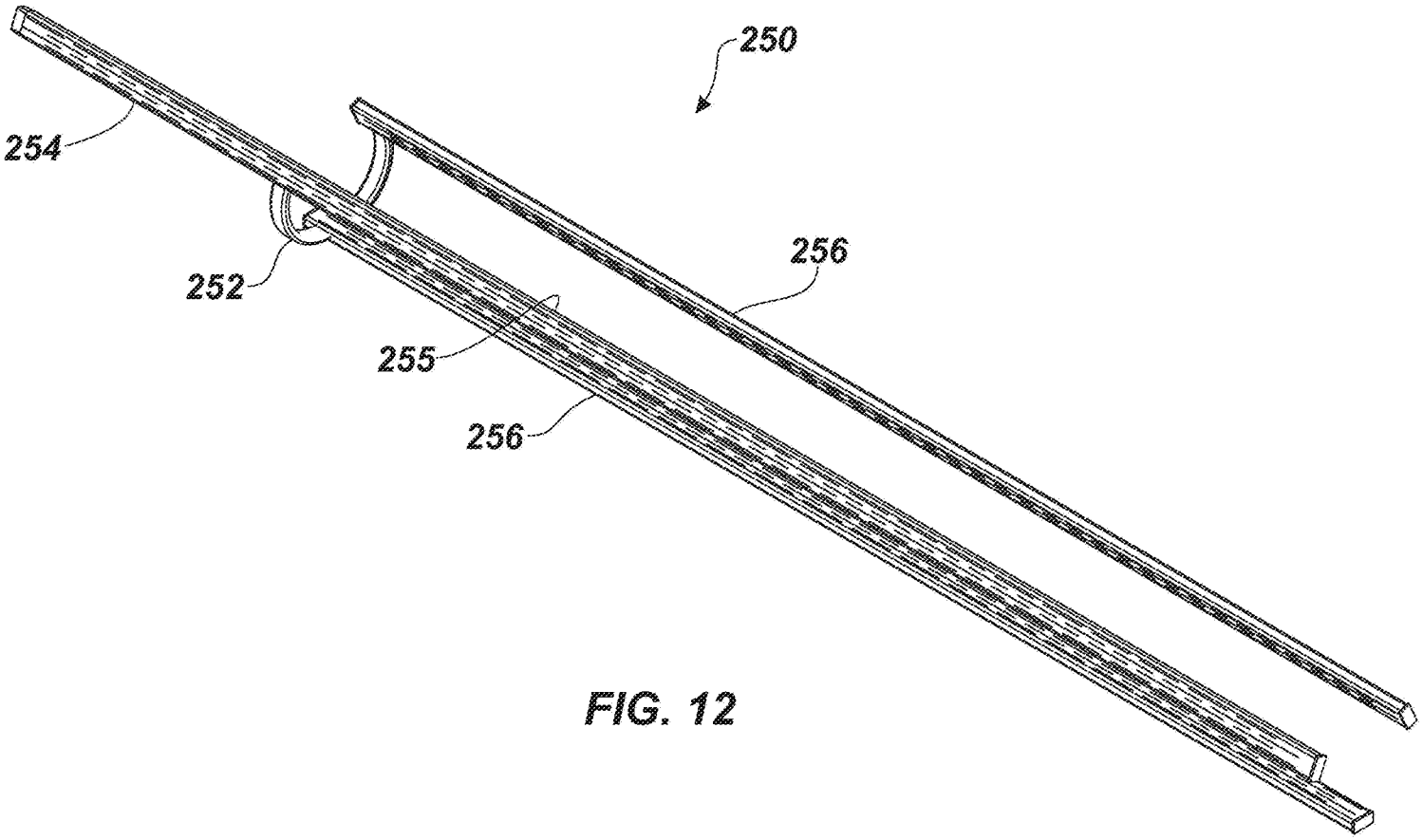
FIG. 12 illustrates an alternate configuration for the disclosed leak-off assembly.

As noted previously, the permeable structures 154 and 158 can include tubes of wire-wrapped screens 170. Also, the manifold 152 can have its space formed by end rings 160*a-b* and a circumferential cover 162. Other configurations can be used as will be appreciated by one skilled in the art having the benefit of the present disclosure. As one example, FIG. 12 illustrates an alternate configuration for a leak-off assembly 250. As shown here, the manifold 252 is a hollow ring or partial ring interconnected to tubes 254 and 256 for conducting leak-off. At least one tube 254 has an end extending beyond one side of the manifold 252 for passage along the blank area between connected joints. The other end 255 of this one tube 254 can extend beyond the opposite side of the manifold 252 to pass along the screen of the joint. Other tubes 256 can extend from this opposite side of the manifold 252 to also pass along the screen of the joint. As an additional difference, the tubes 254, 256 are perforated with a number of perforations, slits, or the like instead of screens for providing the desired filtering. This leak-off assembly 250 can be disposed on the wellscreen assembly 100 in a manner similar to that discussed in previous embodiments.

Figure 13:
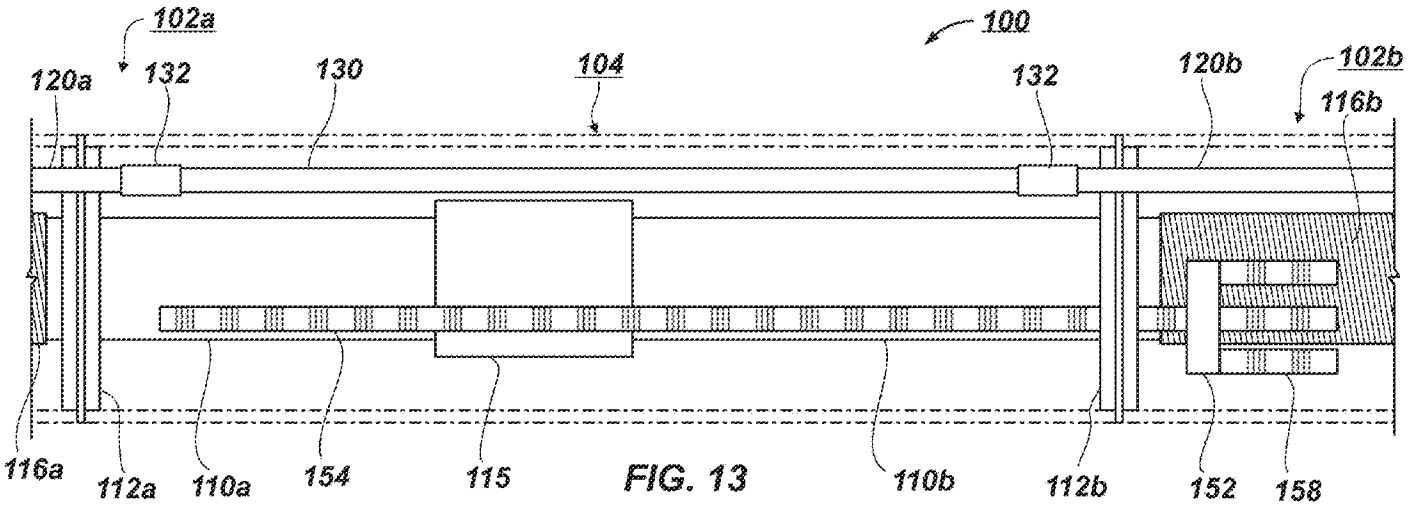
FIG. 13 schematically illustrates the alternate configuration of the assembly in FIG. 12 assembled on a wellscreen assembly.

The manifold 152 (as well as 252) of the disclosed leak-off assemblies 150 may actually be disposed on the opposite side of the top end ring 112*b* from the basepipe's blank area 104. This is schematically depicted in FIG. 13. The manifold 152 is disposed on the permeable side of the basepipe 110*b*. An extended end of the one or more dehydration tubes 254 can pass through a slot or opening in the top end ring 112*b* to communicate with the blank area 104.

One manifold 152 may be sufficient to provide the desired fluid communication, but more than one manifold 152 can be used to provide the necessary fluid communication for each set of dehydrating and conveying structures 154, 158. Additionally, several leak-off assemblies 150 having dehydrating tube(s) 154 feeding into a manifold 152 that feeds into conveying tube(s) 158 can be placed radially around the blank area 104 at the connection of basepipes 110*a-b*.

Figure 14:
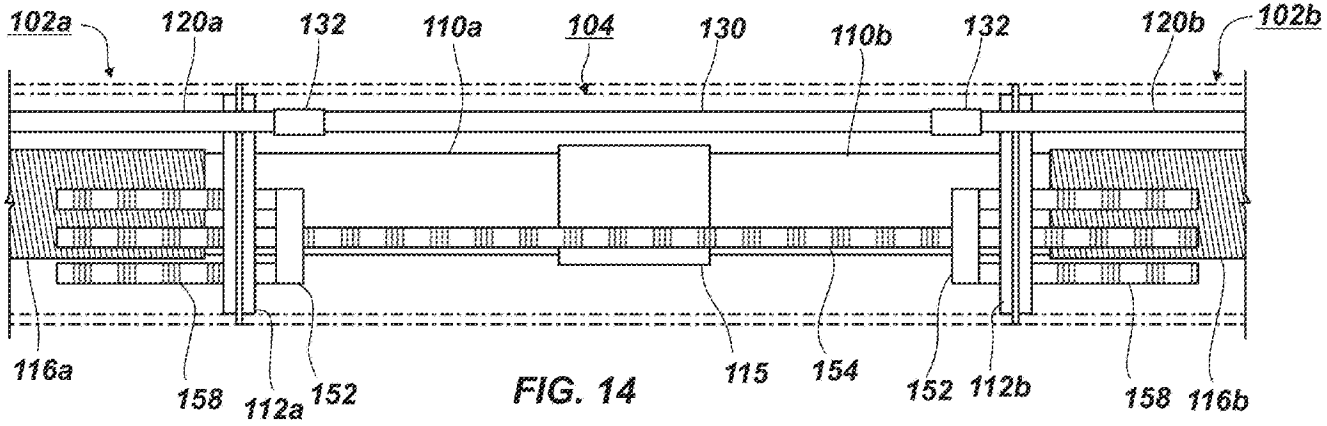
FIG. 14 schematically illustrates an alternate configuration of a leak-off assembly on a wellscreen assembly.

In another example as shown in FIG. 14, one or more dehydrating tube(s) 154 over the blank area 104 of the screen joints 102*a-b* can feed into leak-off manifolds 152*a-b* on the ends 111*a-b* of both adjacent screen joints 102*a-b*. Conveying tubes 158 placed from each of the two manifolds 152*a-b* can then extend adjacent the corresponding screen sections 116*a-b*. The manifolds 152*a-b* may be positioned inside the blank area 104 between the end rings 112*a-b* as shown, but can be positioned elsewhere as discussed herein.

The leak-off assembly 150 of the present disclosure can especially address inefficient leak off problems in open hole gravel pack systems that use transport and shunt tubes to deliver slurry to the borehole annulus. The leak-off assembly increases the effective open area to dehydrate the blank area 104 between the screen joints 102*a-b*. Yet, use of the leak-off assembly 150 is not limited to the blank area 104 of connected screen joints 102*a-b*. In fact, any blank area of a lower completion that is gravel packed can benefit from such a leak-off assembly 150. For example, as shown in FIGS. 6, 8B, and 8C, additional blank areas 106*a-b* on the assembly 100 may have leak-off assemblies 150 as disclosed herein. In particular, such additional leak-off assemblies 150 may be beneficial where blank sections 106*a-b* of the pipe includes rings (e.g., 113) for supporting transport and shunt tubes 120*b*, 140*b* and the like.

As hinted to above, the leak-off assembly 150 can be used in a number of locations along a production string, such as adjacent blank and permeable sections of wellscreen joints in a gravel pack assembly. In some gravel pack implementations, packers can be used at various intervals to isolate zones of the borehole. The packer can be a conventional packer, a swellable packer, a cup packer, or other isolation element.

Figure 15:
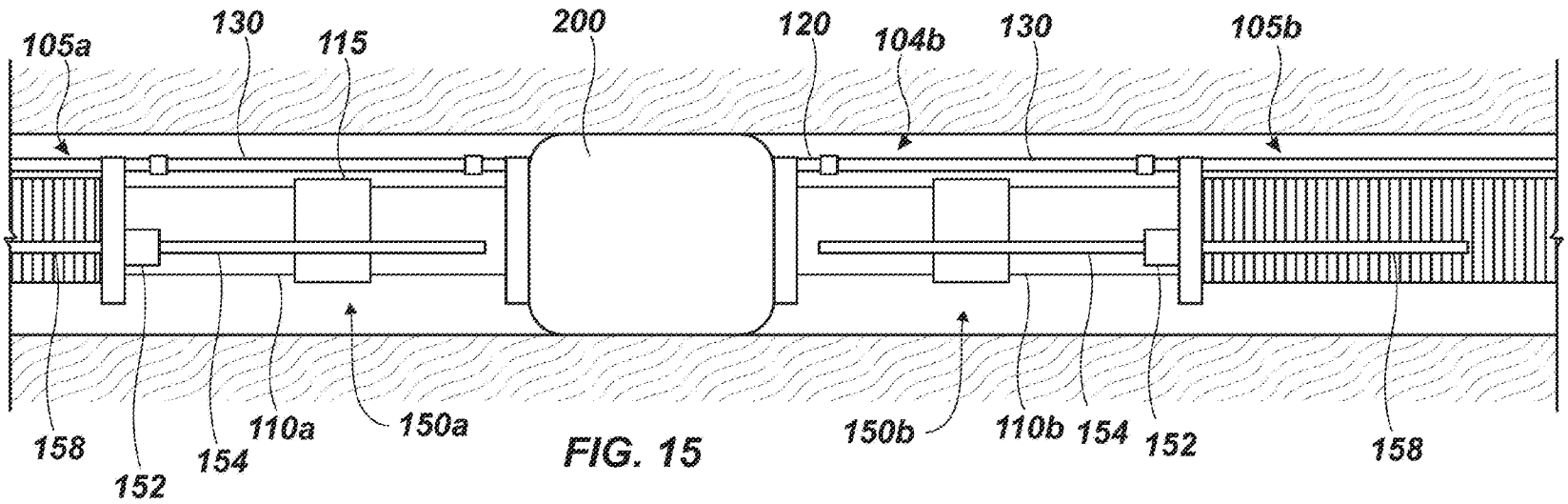
FIG. 15 schematically illustrates use of leak-off assemblies on a wellscreen assembly having a packer.

As shown in FIG. 15, for example, a packer 200, such as a swellable packer, is disposed along the basepipe 110*a-b* in a gravel pack assembly. The packer 200 may be used between permeable sections 105*a-b* (i.e., wellscreens, screens with inflow control devices, etc.). The packer 200 may have transport tubes 120 passing through it to convey slurry for gravel packing operations along other transport tubes 120 and jumper tubes 130 of the assembly.

Even though the packer 200 is adjacent the permeable sections 105*a-b*, it is not uncommon for there to be blank areas 104*a-b* between the packer 200 and the permeable sections 105*a-b*. It may be desirable to gravel pack these blank areas 104*a-b* with gravel to prevent shifting of gravel pack, loss of borehole support, etc. To that end, leak-off assembles 150*a-b* according to the present disclosure can be disposed between the permeable section(s) 105*a-b* and the blank area(s) 104*a-b* of the packer 200 on either one or both sides thereof.

It will be appreciated that any of the various leak-off assemblies 150*a-b* disclosed herein can be used for this purpose. These leak-off assembles 150*a-b* help dehydrate slurry in the borehole annulus around the blank areas 104*a-b* to enhance packing of gravel in these areas 104*a-b*.

Figure 16:
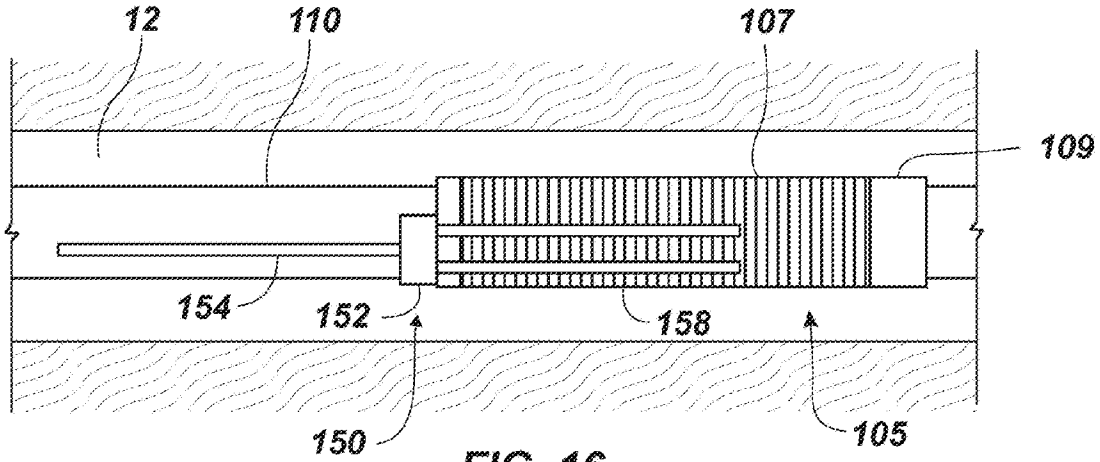
FIG. 16 schematically illustrates use of a leak-off assembly on tubing having blank and permeable sections.

In addition to use at the connection between screen joints, adjacent screen sections, and packers and the like as discussed previously, the disclosed leak-off assembly 150 can be used at any number of locations on a tubing string that can benefit from increased flow area for gravel packing and/or increased flow area for production. For example, FIG. 16 schematically illustrates use of a leak-off assembly 150 on tubing 110 having a blank section 104 and a permeable section 105. The leak-off assembly 150 includes the one or more first permeable structures 154 disposed adjacent the blank section 104 of the tubing 110. These structures 154 conduct filtered fluid to the manifold 152 disposed on the tubing 110. In turn, the one or more second permeable structures 158 conduct the filtered fluid from the manifold 152 adjacent the permeable section 105, which can be a screen, a wellscreen over a perforated portion of tubing, a screen communicating with an inflow control device, a screen along the tubing communication with a sliding sleeve on the tubing string, etc. For example, the permeable section 105 can include a screen 107 disposed along the tubing 110 that connects to an inflow control device 109 for controlling inflow of screened fluid into the tubing 110.

As already noted herein, use of the leak-off assembly 150 of the present disclosure can help with gravel packing a borehole annulus around tubing or basepipe 110, but can also enhance production. Accordingly, the disclosed leak-off assembly 150, whether used for gravel packing or not, can be used in producing fluid into a basepipe or tubing 110 from a borehole annulus. Referring to FIG. 16, for example, the basepipe or tubing 110 disposed in the borehole 10 may or may not be surrounded by gravel pack in the annulus 12. The tubing 110 has a blank section 104 and a permeable section 105. As shown, the blank section 104 is generally an area along the tubing or basepipe 110 where produced fluid cannot enter. However, the permeable section 105 is an area on the tubing 110 for taking up fluid. In general, the permeable section 105 can be a screen, a wellscreen over a perforated portion of the pipe, a screen communicating along the tubing 110 with an inflow control device, a screen communicating along the tubing 110 with a sliding sleeve on the tubing 110, and other types of structures.

The disclosed leak-off assembly 150 can extend the producing area of the tubing 110 by extending into the blank section 104 and communicating to the permeable section 105. The leak-off assembly 150 can do this by installing on the tubing 110 and being configurable to meet particular needs of an implementation. As before, the leak-off assembly 150 has a manifold 152 disposed on the tubing 110, one or more first permeable structures 154 connected from the manifold 152 adjacent the blank section 104, and one or more second permeable structures 158 connected to the manifold 152 adjacent the permeable section 105.

During production, produced fluid collecting in the borehole annulus 12 may pass through gravel (if present). The fluid in the borehole annulus 12 is subsequently filtered into the tubing 110 though the permeable section 105, such as by passing through a screen 107 over perforations in the tubing 110, passing through the screen 107 along the tubing 110 to an inflow control device 109, etc.

Production in this manner does not occur through the blank section 104, which remains unproductive. As is typical, the producing area of a borehole may be exposed to as much as 10% of blank area along a production string. Therefore, increasing the producing area along a production string in such blank areas 104 can have a number of advantages. To that end, the leak-off assembly 150 of the present disclosure can increase the producing area.

During production, the fluid in the borehole annulus 12 at the blank section 104 of the tubing 110 is filtered through the one or more first permeable structures 154 disposed adjacent the blank section 104. The filtered fluid is conducted through the one or more first permeable structures 154 to the manifold 152 disposed on the tubing 110. Then, from the manifold 152, the filtered fluid is conducted through the one or more second permeable structures 158 connected thereto. The filtered fluid can then leak from the one or more second permeable structures 158 to at least adjacent the permeable section 105 to enter the producing tubing 110.

Reference to gravel packing herein may equally refer to fracture packing. Use of the terms such as screen and filter may be used interchangeably herein. Although the assemblies 100 disclosed herein have shown use of transport and shunt tubes, it will be appreciated that the leak-off assembly 150 can be used on assemblies lacking transport and shunt tubes. It will also be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for packing a borehole annulus with gravel carried by a carrier fluid of a slurry, the assembly comprising:

a first basepipe having a first bore, a first permeable section, and a first impermeable section, the first impermeable section disposed on a first connection end of the first basepipe for connection to another basepipe;

a first manifold disposed on the first basepipe and having first and second sides;

one or more first permeable structures in fluid communication with the first side of the first manifold and disposed adjacent at least the first impermeable section on the first connection end of the first basepipe, the one or more first permeable structures filtering the slurry in the borehole annulus adjacent at least the first impermeable section disposed on first connection end and passing the carrier fluid filtered from the slurry to the first manifold; and one or more second permeable structures in fluid communication with the second side of the first manifold and disposed adjacent at least the first permeable section of the first basepipe, the one or more second permeable structures passing the carrier fluid from the first manifold to the borehole annulus adjacent at least the first permeable section.

2. The assembly of claim 1, wherein the first basepipe comprises a first ring disposed on the first basepipe and separating the first permeable section from the first impermeable section.

3. The assembly of claim 2, wherein the first ring supports at least the one or more second permeable structures.

4. The assembly of claim 2, wherein the first ring forms at least a portion of the first manifold.

5. The assembly of claim 4, wherein the first ring comprises at least two segments disposed around the first basepipe, at least one of the at least two segments defining a chamber therein for the first manifold.

6. The assembly of claim 2, wherein the first manifold is disposed separate from the first ring; wherein the one or more second permeable structures are disposed at the first ring; and wherein the system further comprises one or more bypasses communicating the first manifold with the one or more second permeable structures at the first ring.

7. The assembly of claim 2, further comprising a transport tube communicating the slurry, the transport tube disposed along the first basepipe and having a first end disposed at the first ring.

8. The assembly of claim 7, further comprising a shunt tube disposed adjacent the first permeable section of the first basepipe and having a second end disposed at the first ring, wherein the first ring defines at least one passage communicating the slurry from the transport tube to the shunt tube, and wherein the shunt tube expels the slurry to the borehole annulus adjacent the first permeable section.

9. The assembly of claim 7, further comprising a jumper tube having a second end coupled to the first end of the transport tube and disposed adjacent the first impermeable section, the jumper tube communicating the slurry with the transport tube.

10. The assembly of claim 1, wherein the one or more first permeable structures comprises a first number of first tubes.

11. The assembly of claim 10, wherein the one or more second permeable structures comprise a second number of second tubes, the second number being different from the first number.

12. The assembly of claim 1, wherein the one or more first permeable structures comprises one or more screen sections disposed adjacent the first impermeable section.

13. The assembly of claim 12, wherein the one or more screen sections each comprise a housing having a screen disposed over a chamber in the housing.

14. The assembly of claim 1, wherein the first permeable section comprises a first filter disposed on the first basepipe, the first filter filtering the slurry in the borehole annulus and passing the carrier fluid filtered from the slurry into the first bore.

15. The assembly of claim 1, further comprising a second basepipe having a second bore and a second connection end, the second basepipe having a second impermeable section disposed on the second connection end coupled to the first connection end on the first impermeable section of the first basepipe, wherein the first and second impermeable sections of the first and second basepipes provide gripping surfaces for coupling the first and second basepipes together.

16. The assembly of claim 15, further comprising a second manifold disposed on the second basepipe, the one or more first permeable structures being in fluid communication with the second manifold and passing the carrier fluid filtered from the slurry into the second manifold.

17. The assembly of claim 16, further comprising one or more third permeable structure in fluid communication with the second manifold and disposed along a second permeable section of the second basepipe, the one or more third permeable structure passing the carrier fluid from the second manifold to the borehole annulus adjacent the second permeable section.

18. The assembly of claim 1, further comprising a shroud disposed at least about the first impermeable section.

19. An assembly for use on a screen joint for packing a borehole annulus with gravel carried by a carrier fluid of a slurry, the screen joint having a permeable section and an impermeable section, the impermeable section disposed on a first connection end of the screen joint for connection to another screen joint, the assembly comprising:

a manifold positionable adjacent the screen joint and having first and second sides;

one or more first permeable structures connecting in fluid communication with the first side of the manifold and positionable adjacent the impermeable section on the first connection end of the screen joint, the one or more first permeable structures adapted to filter the slurry in the borehole annulus adjacent the first impermeable section disposed on first connection end and adapted to pass the carrier fluid filtered from the slurry to the manifold; and one or more second permeable structures connecting in fluid communication with the second side of the manifold and positionable adjacent the permeable section, the one or more second permeable structures adapted to pass the carrier fluid from the manifold to the borehole annulus adjacent the permeable section.

20. A method of assembling an assembly for packing a borehole annulus with gravel carried by a carrier fluid of a slurry, the method comprising not necessarily in sequence:

assembling a first permeable section on a first basepipe having a first impermeable section disposed on a first connection end of the first basepipe for connection to another basepipe;

positioning a manifold adjacent the first basepipe, the manifold having first and second sides, the manifold providing first communication for one or more first permeable structures on the first side thereof and providing second communication for one or more second permeable structures on the second side thereof; and communicating the manifold with the one or more first permeable structures extending adjacent the first permeable section by connecting the one or more first permeable structures to the first communication on the first side to permit communication of the carrier fluid filtered from the slurry from the manifold to the borehole annulus adjacent the first permeable section on the first basepipe.

21. The method of claim 20, further comprising communicating the manifold with the one or more second permeable structures extending adjacent at least the first impermeable section on the first connection end of the first basepipe by connecting the one or more second permeable structures to the second communication on the second side to permit communication of the carrier fluid filtered from the slurry in the borehole annulus adjacent at least the first impermeable section on the first basepipe.

22. A method of assembling an assembly for packing a borehole annulus with gravel carried by a carrier fluid of a slurry, the method comprising not necessarily in sequence:

connecting a first basepipe to a second basepipe, the first basepipe having a first permeable section and a first impermeable section, the first impermeable section disposed on a first connection end of the first basepipe for connection to the second basepipe;

communicating one or more first permeable structures extending adjacent at least the first impermeable section to a manifold having first and second sides by connecting the one or more first permeable structures to a first communication on the first side of the manifold, the manifold positioned adjacent the basepipe and having one or more second permeable structures extending from a second communication on the second of the manifold adjacent at least the first permeable section;

permitting communication of the carrier fluid filtered from the slurry in the borehole annulus adjacent at least the first impermeable section on the first connection end of the first basepipe to the manifold via the one or more first permeable structures; and permitting communication of the carrier fluid from the manifold to the borehole annulus adjacent the first permeable section on the first basepipe via the one or more second permeable structures.

23. A method of packing a borehole annulus around tubing in a borehole with gravel carried by a carrier fluid of a slurry, the method comprising:

conducting the slurry in the borehole annulus around the tubing in the borehole;

filtering the carrier fluid from the slurry in the borehole annulus into the tubing through a permeable section of the tubing;

filtering the carrier fluid from the slurry in the borehole annulus to one or more first permeable structures disposed adjacent at least an impermeable section of the tubing disposed adjacent the permeable section;

conducting the filtered carrier fluid through the one or more first permeable structures connected to a first side of a manifold disposed on the tubing; and leaking the filtered carrier fluid from the manifold to the borehole annulus adjacent at least the permeable section through one or more second permeable structures connected to a second side of the manifold.

24. A method of producing fluid from a borehole annulus into tubing disposed in a borehole, the method comprising:

filtering the fluid in the borehole annulus into the tubing through a permeable section of the tubing;

filtering the fluid in the borehole annulus at an impermeable section of the tubing, disposed adjacent the permeable section, through one or more first permeable structures disposed adjacent at least the impermeable section;

conducting the filtered fluid through the one or more first permeable structures connected to a first side of a manifold disposed on the tubing;

conducting the filtered fluid from the manifold through one or more second permeable structures connected to a second side of the manifold; and leaking the filtered fluid from the one or more second permeable structures to the borehole annulus adjacent at least the permeable section of the tubing.

* * * * *